US006474471B1

(12) United States Patent
Miyake

(10) Patent No.: US 6,474,471 B1
(45) Date of Patent: Nov. 5, 2002

(54) CAMERA SALES PACKAGE

(75) Inventor: Michihiro Miyake, Asaka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/661,060

(22) Filed: Sep. 13, 2000

(30) Foreign Application Priority Data

Sep. 13, 1999 (JP) ..... 11-258620

(51) Int. Cl.[7] ..... B65D 85/38
(52) U.S. Cl. ..... 206/316.2; 206/471
(58) Field of Search ..... 206/461, 462, 206/463, 469, 471, 316.2, 349; 396/535

(56) References Cited

U.S. PATENT DOCUMENTS 3,651,615 A * 3/1972 Bohner et al. ..... 53/452
4,739,353 A * 4/1988 Heuer et al. ..... 206/316.2
4,739,883 A * 4/1988 Mohs et al. ..... 206/461
4,804,984 A * 2/1989 Heuer et al. ..... 206/316.2
4,899,877 A * 2/1990 Kiernan ..... 206/349
5,143,215 A * 9/1992 Hartley et al. ..... 206/461
5,602,612 A * 2/1997 Angeli et al. ..... 396/535
5,813,546 A * 9/1998 Wilson et al. ..... 206/461

* cited by examiner

*Primary Examiner*—Bryon P. Gehman
(74) *Attorney, Agent, or Firm*—Birch, Stewart, Kolasch & Birch, LLP

(57) ABSTRACT

A package for receiving and storing a camera and corresponding accessories for display, the package including a main body provided with a first camera cavity portion and an accessories cavity portion separated from one another. The camera cavity portion being for accommodating a camera, and the accessories cavity portion being for accommodating accessories for the camera. A protective cover superposed with the main body having a camera second cavity portion for protecting a camera when it is in the first camera cavity portion. The protective cover extends over the accessories cavity portion. First projecting portions are formed at a rear surface of the main body at positions near an outer periphery. The projecting portions for supporting the package in an upright free-standing state and a second projection portion on a front surface protective cover surrounding the camera cavity portion.

24 Claims, 10 Drawing Sheets

CAMERA SALES PACKAGE

BACKGROUND OF THE INVENTION

The present invention relates to a camera sales package in which a camera and camera accessories are packed, the packed camera sales package being suitable for storefront display.

Conventionally, precision goods such as cameras, digital cameras and the like were displayed in storefronts on model-specific display stands and the like. When orders were received, ready-packaged goods were delivered from a warehouse or the like for sale to customers.

In recent years high volume stores have become more numerous. These stores have many products prepared in shelf displays. It is becoming usual for a customer to choose a required product from among the products displayed, go to a cash register, and purchase the product. In this scenario, the product is heavily protected by shock-absorbing packaging members made of styrene or the like, and is packaged inside a box or the like. This packaging does not catch the customer's eye and cannot project the merits of the product.

Consequently, transparent or translucent synthetic resin (plastic and the like) packages, known as blister packs, are becoming more common for sales presentation. Blister packs are suitable for both shelf display and storefront display.

Blister packs can be used for precision engineered goods such as cameras and portable telephones.

However, cameras, particularly digital cameras, tend to have more accessories than other products; e.g., one or more manuals, an AC adaptor, an NTSC video output cable, a cord for connection to a personal computer, and the like. Consequently, packaging that can also hold all the accessories is required.

SUMMARY OF THE INVENTION

In consideration of the above, an object of the present invention is to provide a camera sales package for packaging precision goods such as cameras and the like, especially digital cameras with many accessories, in blister packs. The present invention does not detract from the display appearance of a product when the product is displayed in a storefront, and the present invention can efficiently house a camera body and accessories.

A first aspect of the present invention is a package for receiving and storing a camera and accessories therefor for display, the package including: a main body provided with a camera cavity portion and an accessories cavity portion separated from one another, the camera cavity portion being for accommodating a camera and the accessories cavity portion being for accommodating accessories for the camera; and a protective cover superposed with the main body for protecting a camera in the camera cavity portion and accessories in the accessories cavity portion when a camera and accessories are respectively received therein.

Further, a flange is provided at a periphery of each of the main body and the protective cover, with the flanges superposed with one another and co-joined by ultrasonic welds which are one of continuous and spaced at predetermined intervals.

In the present invention, the camera cavity portion that houses the camera and the accessories cavity portion that houses the accessories are formed separately. Thus, the camera and the accessories are not together and the camera, which is the principal object of display, can be displayed so as to give a good impression.

Further, the camera is housed in the camera cavity portion and shielded by the protective cover. Thus, the camera will not be damaged by external impacts and the product value will not be reduced.

In the camera sales package of the present invention, the flanges are provided at the peripheries of the main body and the protective cover and, with the flanges in the mutually superposed state, the main body and the protective cover are co-joined by ultrasonic welds which are either continuous or spaced at predetermined intervals.

Because ultrasonic welding is used, electromagnetic waves that were necessary for conventional high frequency welding are not required, and the camera and the like, which are precision goods, can be protected.

Further, the flanges include corner portions having a number of ultrasonic weld points per unit area greater in a vicinity thereof than a number of ultrasonic weld points per unit area at another area.

Further, mating portions are formed at a periphery of the camera cavity portion for aligning the main body and the protective cover. Because reference points for alignment are close to the camera, however much other positions are misaligned, the camera, which is the main product, can be assuredly accommodated.

Further, a board including product information is sandwiched between the main body and the protective cover. By printing advertising for the product, the camera, on this board, marketing effectiveness can be improved. Also, graphics can be printed so as to dispel the impression of cheapness associated with blister packs.

Further, a portion of at least one of the main body and the protective cover is one of transparent and translucent, and an ultraviolet light filtering treatment is applied to that portion.

Because the ultra-violet light filtering treatment is applied, the camera and the accessories will not discolor if displayed in a storefront for a long time.

Further, projecting portions are formed at a rear surface of the main body at positions near an outer periphery, the projecting portions being capable of supporting the package in an upright free-standing state.

Blister packs are generally hung for display. However, the product may be, for example, a price leader. In such a case, the package may be displayed on a table in front of a hanging display, where the package can be clearly seen by customer. At this time, because the projecting portions are provided, the package can stand up and the product presented to the customers.

Here, the projecting portions are formed at the accessories cavity portion. Because the center of gravity is low, the package will not fall over.

Further, a front surface of the protective cover is formed into a substantially rounded columnar shape having a large radius of curvature, and the protective cover has a step-shaped portion extending from the substantially rounded columnar shape to the flange of the protective cover, the step-shaped portion having a protruding corner portion with a convex curve and a recessed corner portion with a concave curve.

That is, there are no sharp edges. Thus, when a customer holds the package, there is no sensation of unpleasantness. Also, the package looks very attractive and gives an impression of high quality.

In the present invention, a protruding portion is formed at the protective cover, continuing from an area facing the accessories cavity portion to a periphery of an area facing the camera cavity portion, for protecting a camera therein from impacts.

That is, when the package has been stood up, the same may be knocked down by a force from an external object. Therefore, the protruding portion is formed such that when the package falls, the camera itself will not be subjected to impact. The protruding portion serves as a cushioning member for the camera, and can protect the camera.

Further, the camera includes a port for connection to an external power supply and a through hole is provided at the camera cavity portion corresponding to the port when the camera is accommodated therein, for connection to an external power supply and for removal of air in the package.

For example, if the camera is a digital camera, electricity is required to show a photographic subject on an LCD display portion. If showing this kind of display to customers is desired while the camera is on display, it is troublesome to take the camera out of the package. Moreover, the camera loses value the first time it is taken out of the package. Therefore, by the provision of an adaptor connection through hole, electricity can be supplied to the camera while the camera is still in the package. Also, a through hole is essential for removal of air from the package for strengthening the bonded state of the main body and the protective cover. One hole can be both the air removal through hole and the adaptor connection through hole.

Further, the camera includes a viewfinder and a cylindrical projecting portion is formed at the camera cavity portion, the cylindrical projecting portion having a transparent distal end surface at a position corresponding to the viewfinder of the camera when the camera is accommodated in the package, the distal end surface permitting viewing through the camera viewfinder when the camera is accommodated in the package, and being an impact body for absorbing impacts.

For looking through the camera's viewfinder, a through hole as described above is sufficient. However, in this case the cylindrical projecting portion having the transparent distal end surface is provided. Thus, the viewfinder can be viewed through the transparent distal end surface, and the cylindrical projecting portion can function as a cushioning member when the package falls.

Further, the main body includes an edge to which the camera cavity portion is inclined, the camera cavity portion being capable of accommodating one of a horizontally-oriented camera and a vertically-oriented camera.

Namely, because of this inclination, either a horizontal camera or a vertical camera can be housed in the package without incongruity, and the package can be used for different camera models.

Further, the main body and the protective cover include a common edge integrally joining the main body and the protective cover to provide a folding portion, the package being capable of being closed and opened with the folding portion serving as a hinge.

The main body and the protective cover are joined at a straight edge. In an opened-out state of the package, the camera and accessories are packed in. Then the protective cover is turned about the edge and the packaging process can be completed. Thus, ease of working is improved. Moreover, if the joined state is such that a turning path of the protective cover does not vary, another positioning means is not necessary. If the joined state is such that the turning path of the protective cover does vary, another positioning means will be necessary.

Further, the camera cavity portion is formed such that a depth thereof is less than a thickness of the camera which is accommodated.

Further, the accessories cavity portion is formed in an overall substantially rectangular shape.

Further, a pair of narrow cutaway portions are formed at an upper periphery of the accessories cavity portion.

The size of the rectangular shape is approximately equal to the external dimensions of an instruction manual that is to be housed in the accessories cavity portion. Therefore, the instruction manual can be housed without looseness. Further, a purchaser can insert fingers or the like into the narrow cutaway portions and can take out the instruction manual with ease.

A second aspect of the present invention is a package for receiving and storing a camera for display, the package including: (a) a main body provided with a camera cavity portion adapted for accommodating a camera; (b) a protective cover superposed with the main body for protecting the camera in the camera cavity portion when a camera is accommodated therein; and (c) the main body and the protective cover each having a periphery with a flange, the flanges being superposed with one another when a camera is accommodated in the camera cavity portion, with the flanges co-joined to one another by ultrasonic welds which are one of continuous and spaced at intervals.

In the package according to the second aspect, the camera includes accessories, and the main body includes an accessories cavity portion separate from the camera cavity portion, the accessories cavity being adapted for accommodating camera accessories therein.

A third aspect of the present invention is a blister pack for receiving and storing an electrically powered camera for display, the camera including a jack for connection to an external power supply, the blister pack including: (a) a plastic first portion; and (b) a plastic second portion joinable to the first portion, the portions when joined defining a cavity adapted for receiving the electrically powered camera therein, the cavity including a hole corresponding to the camera jack when the camera is in the cavity defined between the portions, through which an external power supply can be connected to the camera jack and can supply power to the camera for camera demonstration purposes.

DESCRIPTION OF THE PREFERRED EMBODIMENT

Figure 1:
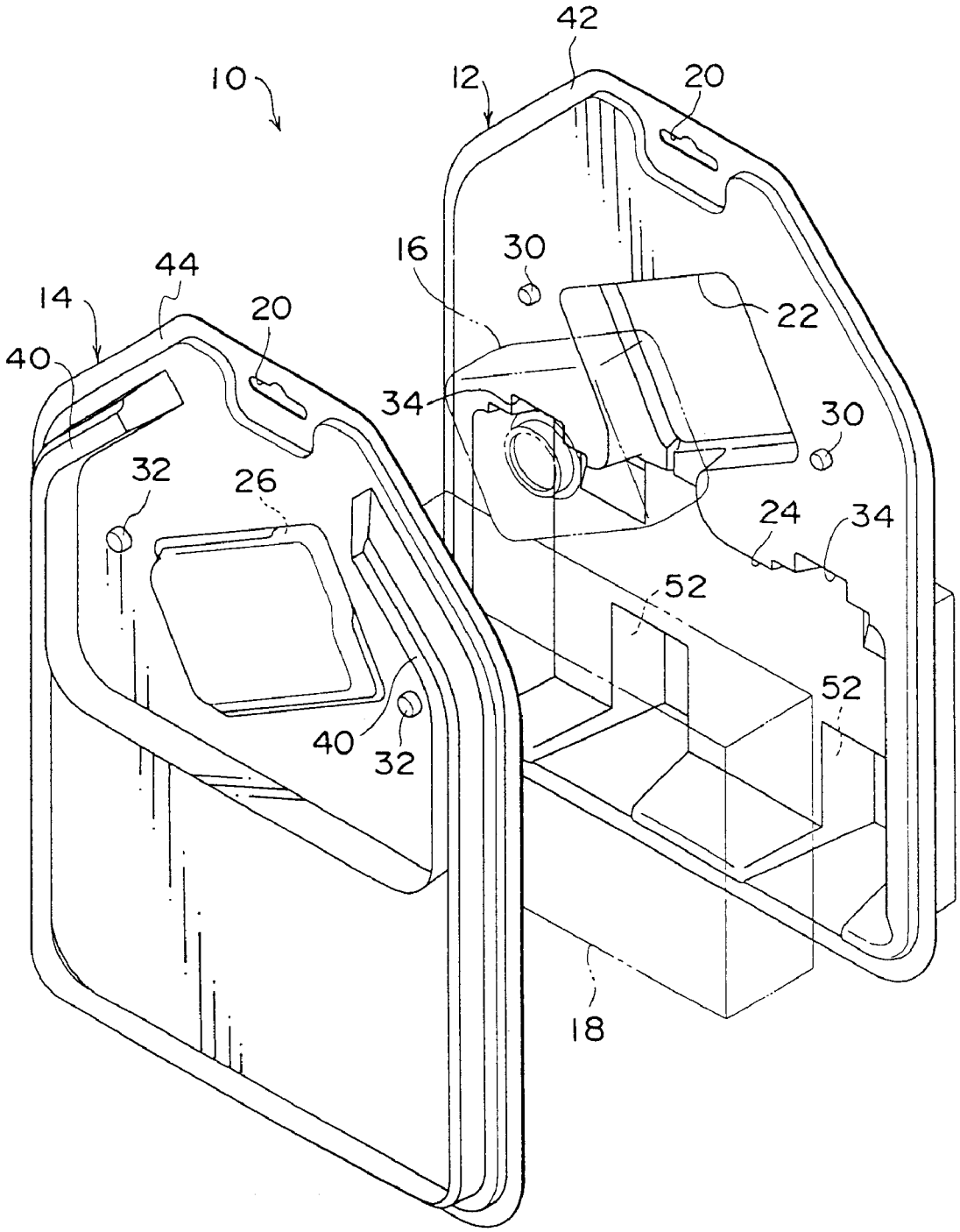
FIG. 1 is an exploded perspective view of a blister pack relating to the present embodiment.
Figure 2:
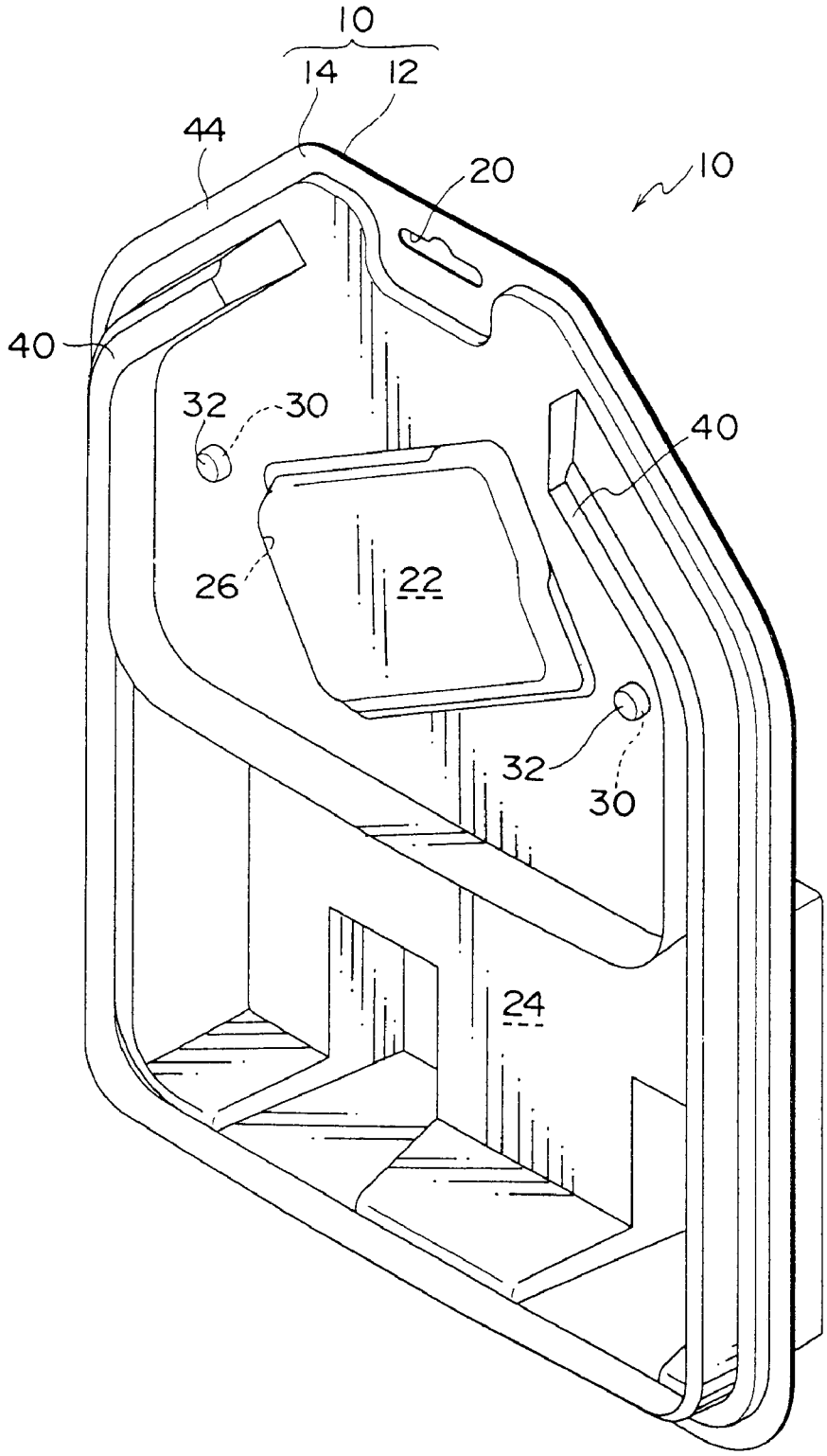
FIG. 2 is a perspective view showing the blister pack relating to the present embodiment.
Figure 3:
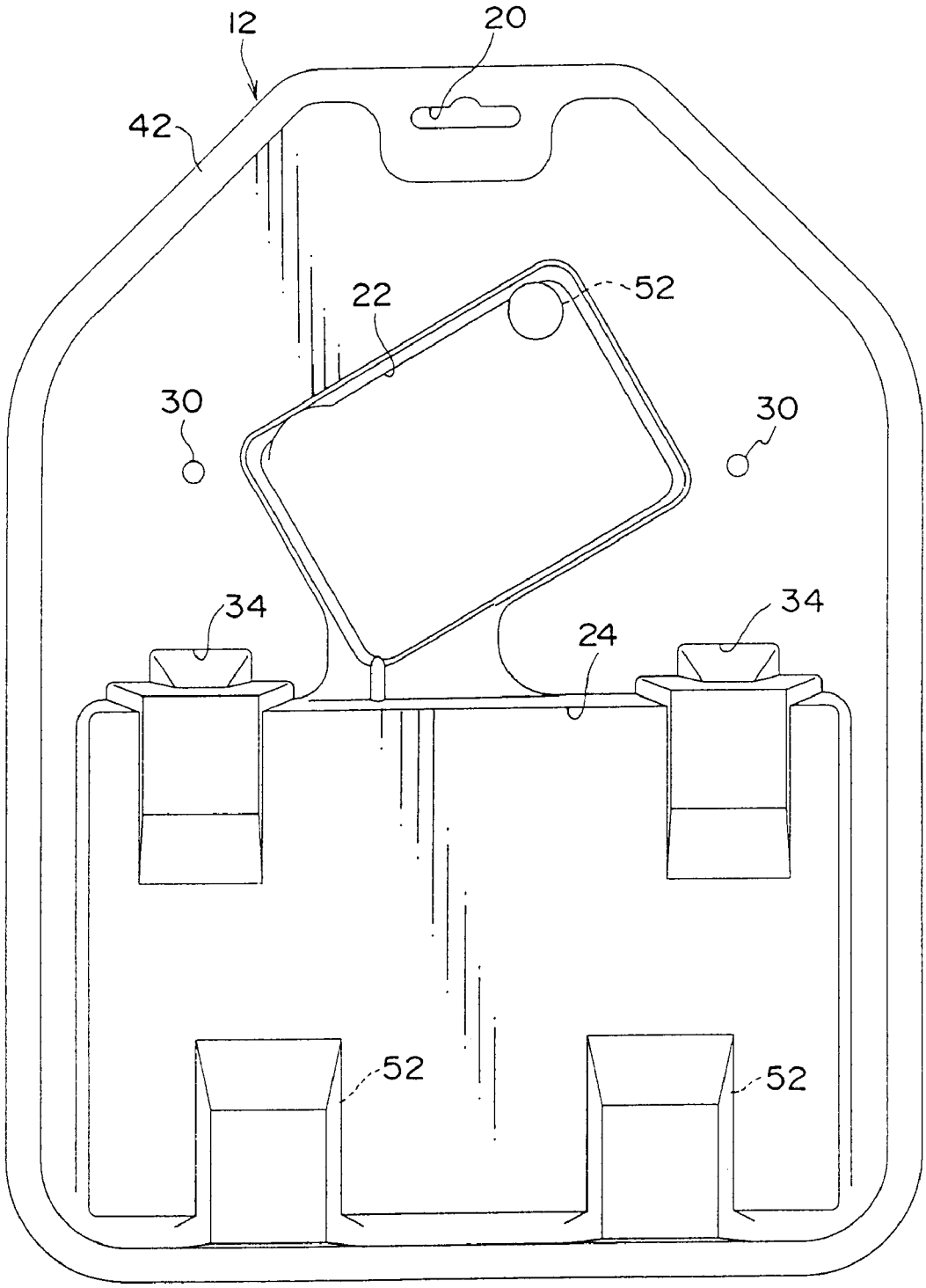
FIG. 3 is a front view of the body of the blister pack.

FIGS. 1 and 3 show a camera sales package (hereinafter called a blister pack) 10 relating to the present embodiment.

The blister pack 10 is formed by two transparent members, a body 12 and a protective cover 14, which members may include translucent portions. By superposition of the body 12 and the protective cover 14, a camera 16 and accessories 18 can be housed. At an upper end portion of the blister pack 10, a long hole 20 is provided, by which the blister pack 10 can suitably hang from a hook or the like for display. In the present embodiment, the housed camera 16 is a digital camera.

The blister pack 10 has a partially trapezoid shape as seen from the front, as shown in FIG. 3. The upper half of the blister pack 10 is a camera housing area and the lower half of the blister pack 10 is an accessories housing area.

A rectangular cavity portion 22 is formed, inclined at a predetermined angle, at the middle of the camera housing area of the body 12. A vertical dimension of the cavity portion (camera cavity portion) 22 corresponds to a vertical dimension of the camera to be housed. A depth dimension of the camera cavity portion 22 is made to be slightly less than a depth dimension of the camera. Consequently, the camera 16 housed in the camera cavity portion 22 will be housed in a state such that the camera 16 protrudes slightly from a front surface of the body 12.

Correspondingly, a shallow cavity portion 26 (which protrudes toward the front in FIG. 1), with a depth corresponding to the distance that the camera 16 protrudes from the camera cavity portion 22, is formed in the protective cover 14. Thus, when the body 12 and the protective cover 14 are in the superposed state, the entire outside of the camera is enclosed and protected.

At a floor portion of the camera cavity portion 22, a cylindrical protruding portion 28 is formed to correspond with the position of a viewfinder of the housed camera 16 (toward the back in FIG. 3). An end surface of the cylindrical protruding portion 28 has high transmissivity and is almost completely transparent. Thus, a customer can look through the viewfinder of the packaged camera.

Further, the cylindrical protruding portion 28 is formed such that, if the blister pack 10 falls, the cylindrical protruding portion 28 can function as a shock-absorbing member and absorb impact force instead of the camera itself.

A pair of protruding portions 30 (protruding toward the front in FIG. 3) are formed at positions to the left and right, in FIG. 3, of the periphery of the camera cavity portion 22. The protruding portions 30 correspond with protruding portions 32 (protruding toward the front in FIG. 1) provided at the protective cover 14.

That is, the protruding portions 30 and the protruding portions 32 are used for positioning when the body 12 and the protective cover 14 are being superposed.

The whole of the accessories housing area of the body 12 is formed into a rectangular cavity portion (accessories cavity portion) 24, which houses accessories such as manuals, an AC adaptor, a video cable, a personal computer cable and the like.

A vertical dimension of the accessories cavity portion 24 is close to the size of the manual which has the largest size. Thus, the manual can be housed without looseness.

A pair of narrow cutaway portions 34 are formed at the upper edge of the accessories cavity portion 24. The cutaway portions 34 allow insertion of a purchaser's fingers when the purchaser is removing the manual. Thus, the tightly housed manual is easy to remove.

Figure 4A:
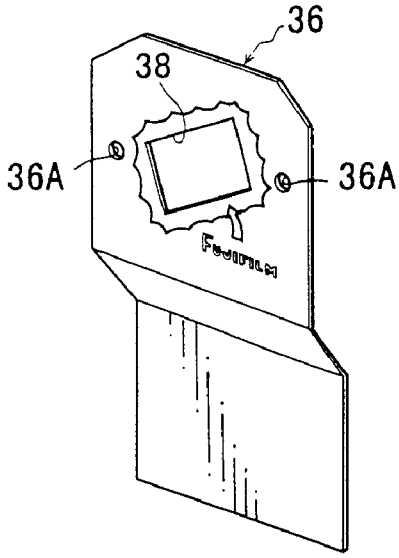
FIG. 4A is a perspective view of a display card of the present embodiment.

Further, when the accessories are housed in the accessories cavity portion 24, a display card 36 (see FIG. 4A) is placed over the accessories. As shown in FIG. 4A, the model name and type of the housed camera, illustrations showing use of the camera, and the like can be printed on the display card 36.

Figure 4B:
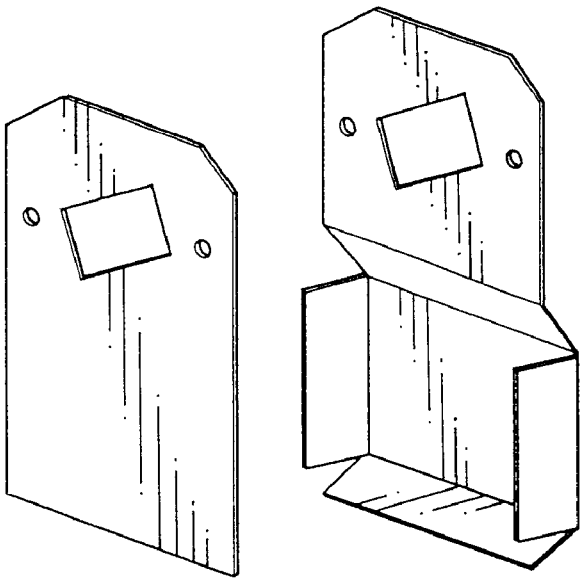
FIG. 4B is a variant view showing example of the display card of the present embodiment.
Figure 4C:
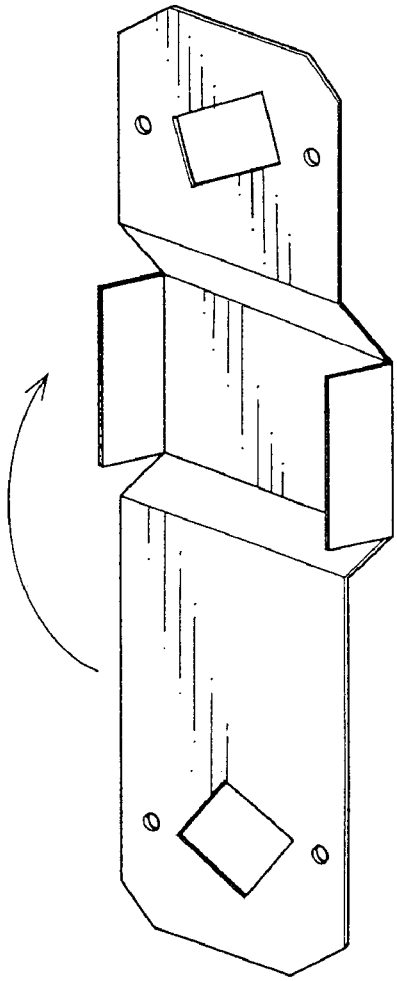
FIG. 4C is a variant view showing example of the display card of the present embodiment.

The display card 36 reaches up to the camera cavity portion 22. A through-hole 38 is provided in the display card 36 in correspondence with the camera cavity portion 22. Depending on the configuration of the display card 36, the camera can be exposed and the accessories concealed. Moreover, the display card 36 may also have one of the variant forms shown in FIGS. 4B and 4C.

The surface of the protective cover 14 corresponding to the accessories cavity portion 24 is, viewed from below, a curved surface with a large radius of curvature, is a projection centered in a widthwise direction, and forms a substantially rounded columnar shape. This is an effect of vacuum formation of the protective cover 14, which makes the protective cover 14 bulge out and works to enhance the appearance thereof.

The substantially rounded columnar surface has high transmissivity and is almost completely transparent. Thus, the information on the display card 36 can be clearly seen.

This transparent surface of the protective cover 14 extends in narrow belt shapes from the upper left and upper right corner portions of the substantially rounded columnar surface to above the shallow cavity portion 26. The transparent surface is more protrusive than the outer surface of the shallow cavity portion 26. Thus, the periphery of the shallow cavity portion 26 is substantially surrounded by belt-like protruding portions 40. Because of this shape, when the blister pack 10 falls, the belt-like protruding portions 40 receive an impact before the shallow cavity portion 26, which is formed in the protective cover 14 at the front side of the camera (protruding toward the front in FIG. 1). Thus, impact on the camera 16 via the shallow cavity portion 26 can be avoided.

Flanges 42 and 44 are integrally formed along the whole length of the peripheries of the body 12 and the protective cover 14 forming the blister pack 10. The protective cover 14 and the body 12 are superposed by positioning of the protruding portions 30 and the protruding portions 32, and mating surfaces of the flanges 42 and 44 are co-joined.

Figure 5:
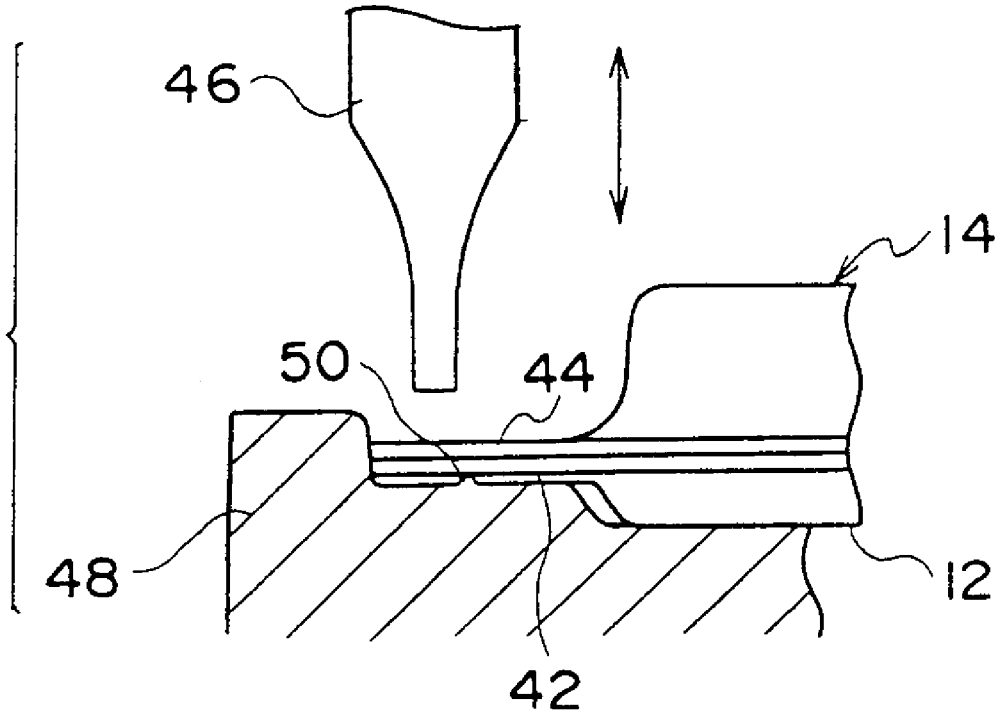
FIG. 5 is a schematic view of an ultrasonic welding device.

In the present embodiment an ultrasonic welder is used for this co-joining. The ultrasonic welder is formed, as shown in FIG. 5, by a horn 46 that emits ultrasonic waves and a cradle 48 that positions workpieces (the body 12 and the protective cover 14). The workpieces are placed on the cradle 48 and gripped thereto by the horn 46 with a predetermined pressure. Local frictional heating is generated in the workpiece by application of ultrasonic vibrations. Thus, the workpieces are melted and co-joined.

Conventionally, for ultrasonic welding, protruding portions were provided at the workpieces. In the present embodiment, however, protruding portions 50 are provided at the cradle 48. Thus, the workpieces do not need to be processed.

Figure 10:
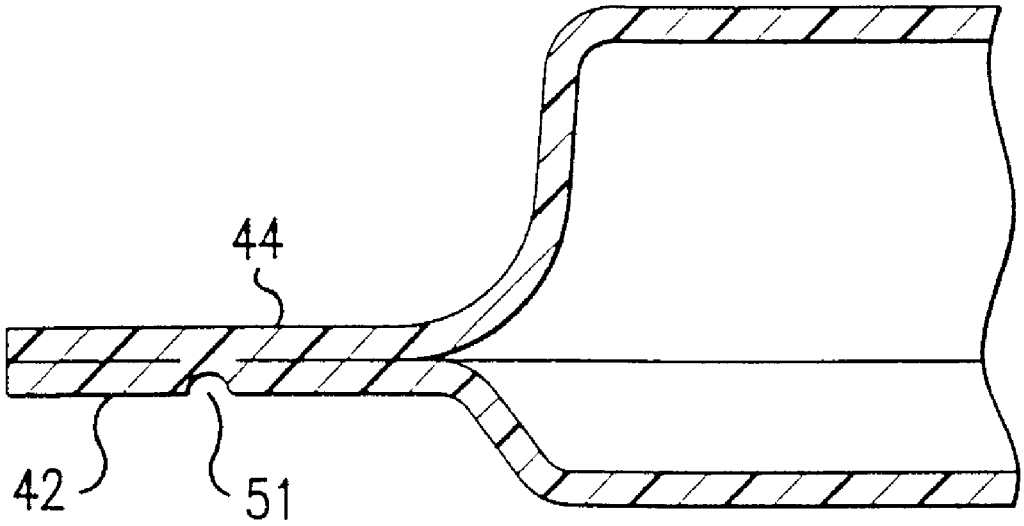
FIG. 10 depicts a cross section of a weld.

As shown in FIG. 10, after co-joining, there are recessed portions 51 in the flange 42 of the body 12, which is facing the cradle 48. However, the flange 44 of the protective cover 14 remains flat.

Figure 6:
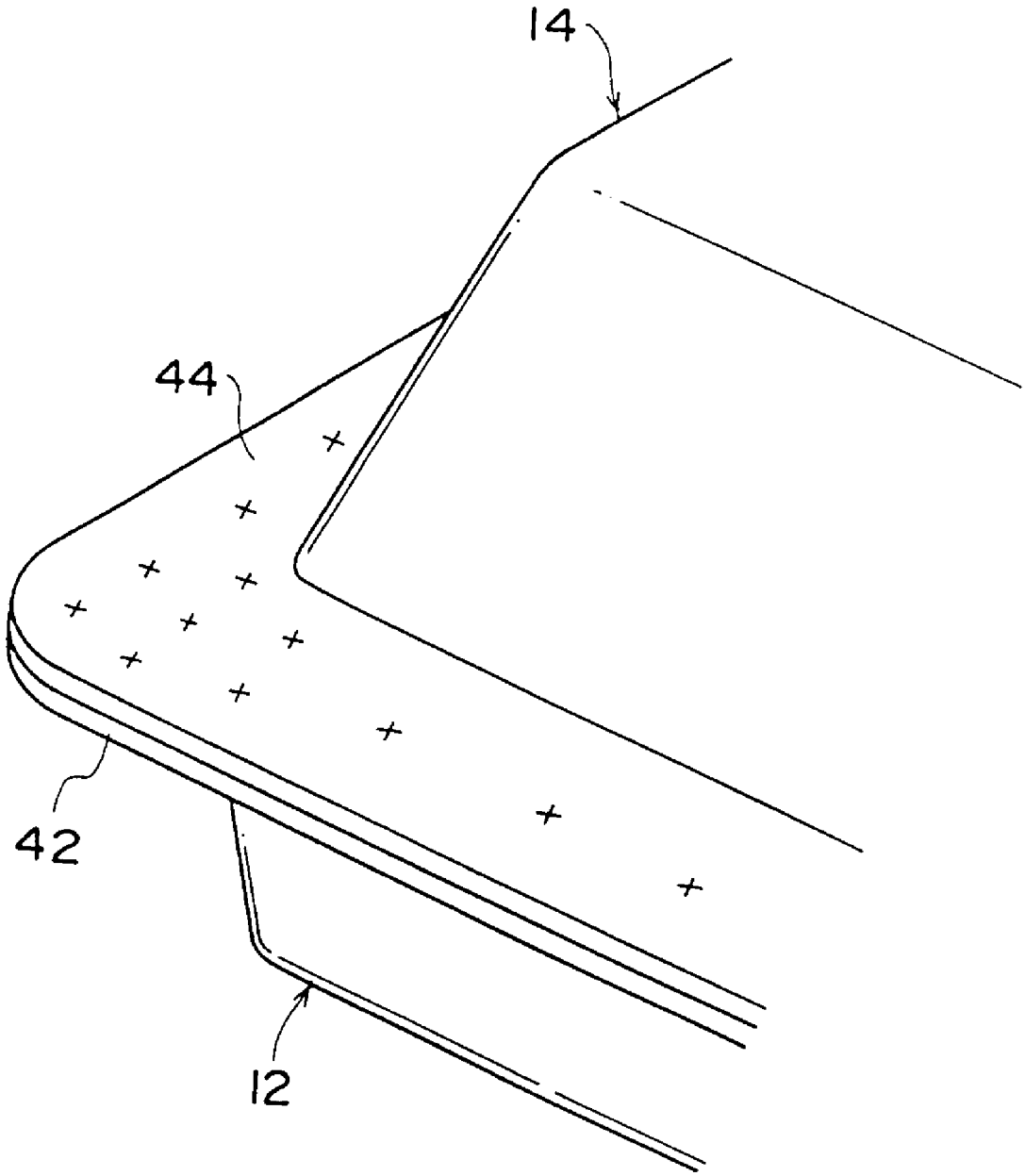
FIG. 6 is a perspective view showing intermittent positions of ultrasonic welds at a flange.

The protruding portions 50 provided at the cradle 48 are provided with a predetermined spacing. However, at corner portions of the flanges 42 and 44, as shown in FIG. 6, the protruding portions 50 are closer to each other than the predetermined spacing. Thus, the corner portions are strongly co-joined and, even if one of the corner portions receives an impact from a fall or the like, that corner portion will not separate.

Figure 7:
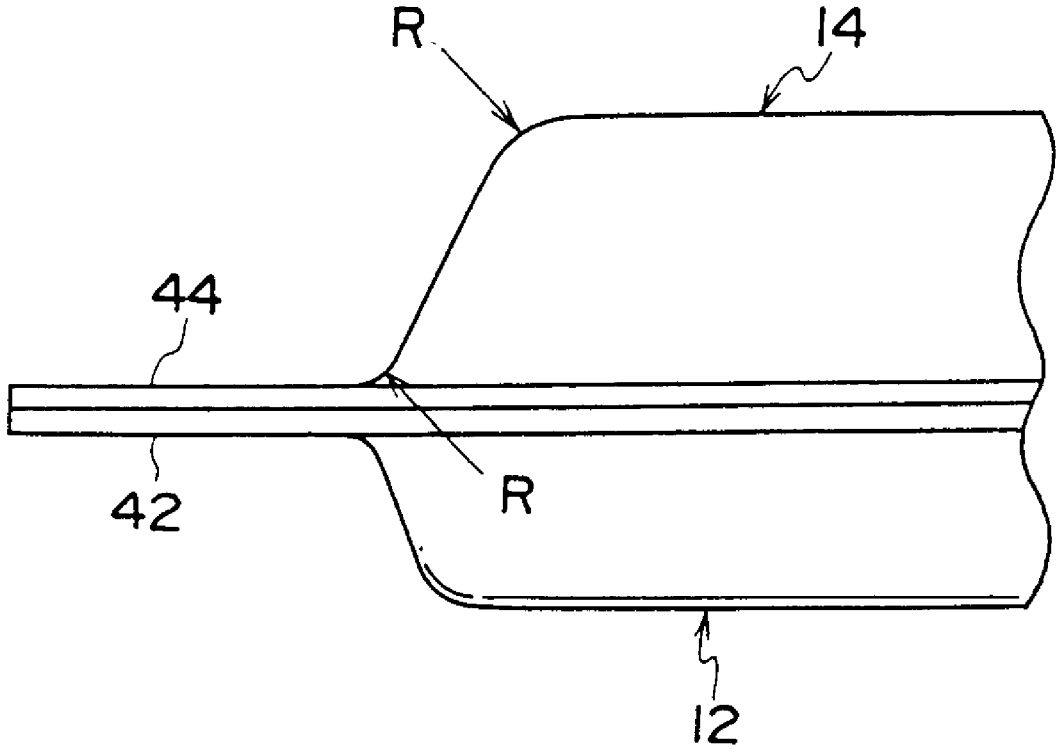
FIG. 7 is an enlarged partial side view showing processing of a periphery of the blister pack.

The cross-sectional form of the junction between the protective cover 14 and the flange 44, which is formed around the periphery of the protective cover 14, is a step shape. A protruding corner portion of this step shape is a convex curve and a recessed corner portion of the step shape is a concave curve. All elements of the step shape are formed continuously (see FIG. 7).

Figure 8:
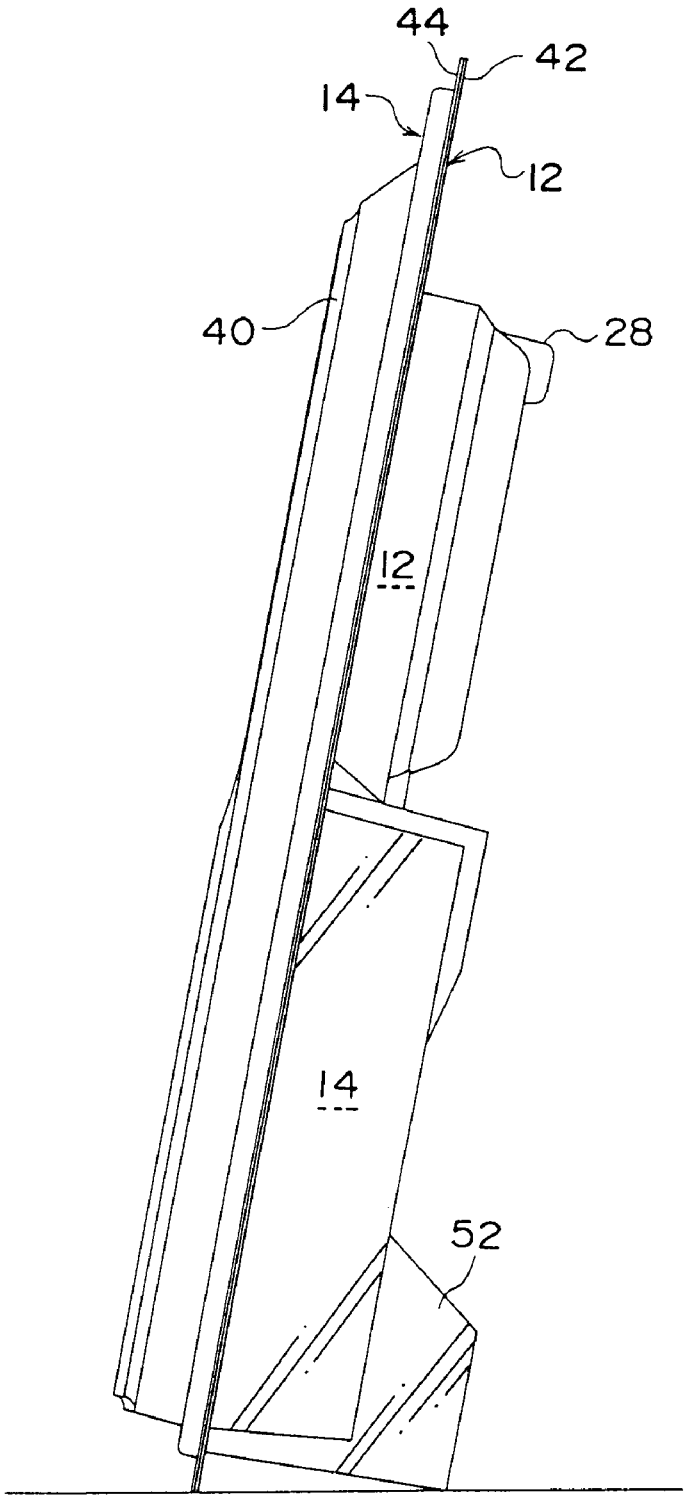
FIG. 8 is a side view showing the blister pack in a stood up state.

A pair of protruding portions 52 are formed at a floor surface of the accessories cavity portion 24 at the rear side of the body 12. The protruding portions 52 act as supports when the blister pack 10 is stood up with the camera cavity portion 22 at the top and the accessories cavity portion 24 below. Thus, one blister pack 10 can stand alone on a table or the like. Further, when the accessories 18 are housed in the accessories cavity portion 24, the center of gravity of the blister pack 10 is in the vicinity of the protruding portions 52. Thus, the structure is such that the blister pack 10 is not likely to fall over (see FIG. 8).

Operation of the present embodiment is described below.

When products are being housed in the blister pack 10, the camera 16 and the accessories 18 are separately housed in the camera cavity portion 22 and the accessories cavity portion 24. That is, the camera 16 is housed in the camera cavity portion 22 and the accessories 18 are housed in the accessories cavity portion 24. Thus, the camera 16 can be held without freedom of movement, and a plurality of accessories can be housed together.

Because the camera 16 is housed separately from the accessories 18, the camera 16 is not in a state wherein it cannot be seen under display conditions. Thus, the camera 16 can be displayed in a condition such that the camera 16 will assuredly catch a customer's eye.

Moreover, because the accessories 18 are covered by the display card 36, the accessories 18 cannot be seen from outside and the blister pack 10 has a good appearance.

The assembly procedure of the blister pack 10 is as follows. First, the camera 16 and the accessories 18 are housed in the camera cavity portion 22 and the accessories cavity portion 24, as described above. Then, the display card 36 is put on. Round holes 36A formed in the display card 36 engage with the protruding portions 30 formed at the body 12, to the left and right of the camera cavity portion 22. Thus, the display card 36 can be positioned easily.

Then, the protective cover 14 is fitted on such that the protruding portions 30 and the protruding portions 32 formed at the protective cover 14 align. Thus, the flange 42 and the flange 44 are superposed.

Because the protruding portions 30 and the protruding portions 32 are provided in the vicinity of the camera cavity portion 22, even if the positions of the body 12 and the protective cover 14 are misaligned, any effect thereof on the area housing the camera 16 can be minimized. In other words, even in a worst case scenario, the camera 16 can be reliably held in the package.

In this assembled state, the blister pack 10 is positioned on the cradle 48 for ultrasonic welding. The blister pack 10 is gripped between the horn 46 and the cradle 48, and ultrasonic welding is performed. Here, in the present embodiment, the protruding portions 50 are provided at the cradle 48. Thus, there is no need for anything to be formed at the flange 42 and the flange 44.

At the protruding portions 50, intermolecular joining is performed by the ultrasonic waves, and the flange 42 and the flange 44 are co-joined. At this time, because the cradle 48 has more of the protruding portions 50 at positions corresponding to the corner portions of the flange 44 than at other positions, the corner portions, at which stresses tend to concentrate, can have a higher welding strength. Consequently, even if impacts are received because of falls and the like, there will not be problems such as the body 12 and the protective cover 14 separating.

The long hole 20 is formed in the blister pack 10 for display thereof in a hanging condition. Thus, the blister pack 10 is suitable for storefront display in a high volume store. There may also be cases, such as when the product is a price leader, in which, rather than a hanging display, a table installation display is required.

In such a case, with the blister pack 10 of the present embodiment, the protruding portions 52, which can function as leg portions, are already provided. Thus, the blister pack 10 can be stood up with the comparatively heavy accessories cavity portion 24 positioned toward the bottom. Because the center of gravity is at a low portion, the stood-up state is reliably maintained unaided.

Straight lines and corners have been almost entirely eliminated in the blister pack 10 of the present embodiment, and the front surface of the protective cover 14 corresponding to the accessories cavity portion 24 has a substantially rounded columnar shape. Thus, the appearance is good. At the step down to the flange 44 at the periphery, the protruding corner portion is a convex curve and the recessed corner portion is a concave curve. Thus, when a customer holds the blister pack 10, there is no unpleasant sensation. Moreover, external flaws at a time of vacuum forming, which process is often used for forming blister packs, can be reduced.

When the blister pack 10 is stood up for display, it is not possible to completely prevent falls: the blister pack 10 could be knocked down by an impact from some other item. In the present embodiment, around the shallow cavity portion 26 part of the protective cover 14 that houses the camera 16 (protruding toward the front in FIG. 1), the belt-like protruding portions 40, which protrude further toward the front than the cavity portion 26, are provided. Thus, if the blister pack 10 happens to fall forward, the belt-like protruding portions 40 will receive an impact before the cavity portion 26. The belt-like protruding portions 40 will absorb the impact, and impact on the camera 16 can be avoided.

Further, the cylindrical protruding portion 28 is formed at the rear side of the camera cavity portion 22. Thus, if the blister pack 10 falls backward, the cylindrical protruding portion 28 receives an impact first, and impact on the camera 16 can be reduced.

The cylindrical protruding portion 28 is at the position of the camera 16 viewfinder and the end surface of the cylindrical protruding portion 28 is completely transparent. Thus, a customer can look through the viewfinder of the camera 16 in the packaged state.

In the present embodiment of the blister pack 10, the camera 16 is held diagonally. Thus, the camera 16 can be a horizontal camera or a vertical camera, and the display state does not give a sense of incongruity in either case. Also, provided the dimensions are about the same, the blister pack 10 can be used for different models.

In the blister pack 10 of the present embodiment, the body 12 and the protective cover 14 may be provided with an ultra-violet light filtering layer. Hence, even if the camera is displayed for long periods in a storefront in direct sunlight, discoloration of the camera and the like in the blister pack 10 can be prevented.

Figure 9:
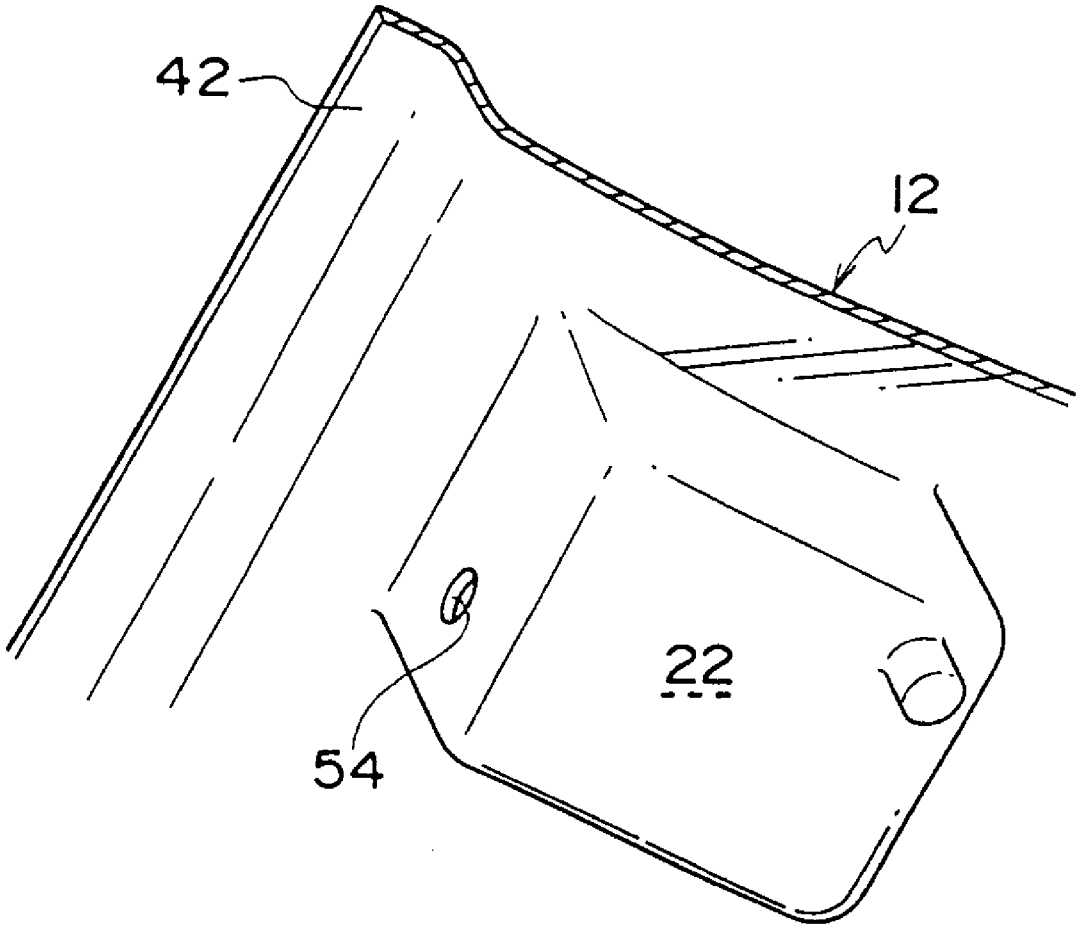
FIG. 9 is a perspective view, from the rear, of a camera cavity portion.

A through-hole must be provided in the blister pack 10 for removal of internal air. As shown in FIG. 9, a through-hole 54 is provided in the camera cavity portion 22, at the position of a power supply connection. The through-hole 54 can usually be used for removal of air, and an external power supply can be attached, for example, when the camera's LCD display is being operated while on display.

In the present embodiment, the body 12 and the protective cover 14 are separate. However, the structure could be such that, for example, the body 12 and the protective cover 14 are joined at the bottom edge or the left or right edge. In this case, the camera 16 and the accessories 18 are housed while the protective cover 14 is in an opened-out state, and the protective cover 14 is then turned about the joining edge to close the blister pack 10.

As described above, the camera sales package relating to the present invention has excellent effects in that it does not detract from the display appearance of precision goods such as cameras, particularly digital cameras with many accessories, which are displayed in blister packs in a storefront, and in that it can efficiently house a camera and accessories.

What is claimed is:

1. A package for receiving and storing a camera and accessories therefore for display, the package comprising:

a main body provided with a first camera cavity portion and an accessories cavity portion separated from one another, the first camera cavity portion for accommodating a camera and the accessories cavity portion for accommodating accessories for the camera;

a protective cover superposed with the main body having a second camera cavity portion for protecting the camera in the first camera cavity portion, the protective cover extending over the accessories cavity portion; and a first projection portion defined by the protective cover and surrounding the second camera cavity portion, the first projection portion extending a first distance from a surface of the protective cover and the second camera cavity portion extending a second distance from the surface, the first distance being relatively larger than the second distance.

2. The package of claim 1, wherein a flange is provided at a periphery of each of the main body and the protective cover, with the flanges superposed with one another and co-joined by ultrasonic welds which are one of continuous and spaced at predetermined intervals.

3. The package of claim 2, wherein the flanges include corner portions having a number of ultrasonic weld points per unit area greater in a vicinity thereof than a number of ultrasonic weld points per unit area at another area.

4. The package of claim 2, wherein the first projection portion is a substantially rounded columnar shape having a large radius of curvature, and the first projection portion has a step-shaped portion extending from the substantially rounded columnar shape to the flange of the protective cover, the step-shaped portion having a protruding corner portion with a convex curve and a recessed corner portion with a concave curve.

5. The package of claim 1, wherein a mating portion is formed at a periphery of the first camera cavity portion for aligning the main body and the protective cover.

6. The package of claim 5, further comprising:

a board including product information sandwiched between the main body and the protective cover.

7. The package of claim 1, wherein a portion of at least one of the main body and the protective cover is one of transparent and translucent, and an ultra-violet light filtering treatment is applied to said portion.

8. The package of claim 1, wherein projecting portions are formed at a rear surface of the main body at positions near an outer periphery, the projecting portions being capable of supporting the package in an upright free-standing state.

9. The package of claim 8, wherein the second projecting portions are formed at the accessories cavity portion.

10. The package of claim 1, further comprising:

a through hole provided at the first camera cavity portion corresponding to a port of the camera when the camera is accommodated therein, for connection to an external power supply and for removal of air in the package.

11. The package of claim 1, further comprising:

a cylindrical projecting portion is formed at the first camera cavity portion, the cylindrical projecting portion having a transparent distal end surface at a position corresponding to a viewfinder of the camera when the camera is accommodated in the package, the distal end surface permitting viewing through the camera viewfinder when the camera is accommodated in the package, and being an impact body for absorbing impacts.

12. The package of claim 1, wherein the main body includes an edge to which the first camera cavity portion is inclined, the camera cavity portion being capable of accommodating one of a horizontally-oriented camera and a vertically-oriented camera.

13. The package of claim 1, wherein the main body and the protective cover include a common edge integrally joining the main body and the protective cover to provide a folding portion, the package being capable of being closed and opened with the folding portion serving as a hinge.

14. The package of claim 1, wherein the first camera cavity portion is formed such that a depth thereof is less than a thickness of the camera which can be accommodated therein.

15. The package of claim 1, wherein the accessories cavity portion is formed in an overall substantially rectangular shape.

16. The package of claim 15, wherein a pair of narrower cutaway portions are formed at an upper periphery of the accessories cavity portion.

17. A package for receiving and storing a camera for display, the package comprising:

(a) a main body provided with a camera cavity portion adapted for accommodating the camera;

(b) a protective cover superposed with the main body for protecting the camera in the camera cavity portion when the camera is accommodated therein; and (c) the main body and the protective cover each having a periphery with a flange, the flanges being superposed with one another with the flanges co-joined to one another by ultrasonic welds which are spaced at first intervals along lateral portions of the flanges and spaced at second intervals at corner portions of the flanges.

18. The package of claim 17, wherein the main body includes an accessories cavity portion separate from the camera cavity portion, the accessories cavity portion being adapted for accommodating camera accessories therein.

19. The package of claim 17, wherein the flange of the main body portion has a recessed area in the location of a weld and the flange of the protective cover does not have a recessed area in the location of a weld.

20. The package of claim 17, wherein the first intervals are relatively larger than the second intervals.

21. A blister pack for receiving and storing an electrically powered camera for display, the camera including a jack for connection to an external power supply, the blister pack comprising:

(a) a plastic first portion; and (b) a plastic second portion joinable to the first portion, the portions when joined defining a cavity adapted for receiving the electrically powered camera therein, the cavity including a hole corresponding to the camera jack when the camera is in the cavity defined between the portions, through which an external power supply can be connected to the camera jack and can supply power to the camera for camera demonstration purposes.

22. A blister package for holding devices, the package comprising:

a main body portion defining a first cavity, a separate second cavity, and a first projection portion, the first projection portion located on a lower portion of the main body portion and the first cavity being separate from the second cavity; and a protective cover superimposed over the main body portion, the protective cover defining a third cavity and the second projection portion, the third cavity projecting away from a surface of the protective cover by a first distance and superimposed over the first cavity and the second projection portion projecting away from the surface of the protective cover a second distance which is relatively greater than the first distance.

23. The package of claim 22, further comprising a first flange on the main body and a second flange on the protective cover; and a seal on the first flange and the second flange holding the main body and protective cover together.

24. The package of claim 23, wherein the seal includes welds spaced apart a first distance on lateral portions of the first and second flanges; and corner welds on at least one corner portion of the first and second flanges, the corner welds spaced apart a second distance which is relatively smaller than the first distance.

* * * * *